US005337431A

United States Patent [19]

Kim et al.

[11] Patent Number: 5,337,431

[45] Date of Patent: Aug. 16, 1994

[54] APPARATUS FOR AND METHOD OF DETERMINING QUALITY OF CLOTHES TO BE WASHED

[75] Inventors: Jung H. Kim, Seoul; Hyung S. Kim, Kyungki; Byeong H. Lee, Kyungki; Young H. Roh, Kyungki; Hae Y. Chung, Seoul, all of Rep. of Korea

[73] Assignee: Goldstar Co., Ltd., Rep. of Korea

[21] Appl. No.: 126,034

[22] Filed: Sep. 23, 1993

[30] Foreign Application Priority Data

Jun. 19, 1993 [KR] Rep. of Korea ..... 11228/1993

[51] Int. Cl.[5] ..... D06F 33/02

[52] U.S. Cl. ..... 8/159; 68/12.02; 68/12.27

[58] Field of Search ..... 8/159; 68/12.01, 12.02, 68/12.04, 12.27

[56] References Cited

U.S. PATENT DOCUMENTS

| | | | |
|---|---|---|---|
| 5,072,473 | 12/1991 | Thuruta et al. | 8/159 |
| 5,144,819 | 9/1992 | Hiyama et al. | 68/12.04 |
| 5,161,393 | 11/1992 | Payne et al. | 68/12.04 |
| 5,208,931 | 5/1993 | Williams et al. | 8/159 |
| 5,230,228 | 7/1993 | Nakano et al. | 68/12.02 X |

*Primary Examiner*—Philip R. Coe

*Attorney, Agent, or Firm*—Ostrolenk, Faber, Gerb & Soffen

[57] ABSTRACT

Clothes quality determining apparatus and method capable of analyzing a sensing signal indicative of the quality of clothes to be washed in a washer, to determine whether the clothes quality signal is a clothes quality signal or a noise, and controlling a rotation force of the washer according to the determined clothes quality signal, thereby minimizing a damage of clothes. The apparatus includes a clothes quality sensing unit for sensing the quality of clothes from the magnitude of an impact generated by the clothes and generating a clothes quality signal, a correlation coefficient operating unit for analyzing the clothes quality signal outputted from the clothes quality sensing unit and outputting a correlation coefficient for determining whether the clothes quality signal is a meaningful signal or a noise, and a microprocessor for controlling a rotation speed of the washer according to the clothes quality signal, when the clothes quality signal currently inputted is determined to be the meaningful signal, from the correlation coefficient.

4 Claims, 4 Drawing Sheets

APPARATUS FOR AND METHOD OF DETERMINING QUALITY OF CLOTHES TO BE WASHED

BACKGROUND OF THE INVENTION

1. Field of the Invention

The present invention relates to a washer, and more particularly to an apparatus for and a method of determining the quality of clothes to be washed in a washer.

2. Description of the Prior Art

In a conventional apparatus for determining the quality of clothes to be washed in a washer, a clothes quality signal is sensed, which is generated according to the quantity of clothes to be washed and a degree that a washing tub of the washer is inclined toward one side. The sensed clothes quality signal is compared with a reference signal through a comparator, for determining whether it is higher or lower than the reference signal. Based on the result of the comparison, the quality of clothes to be washed is determined.

However, such a conventional apparatus can not determine correct quality of clothes to be washed, because the clothes include cloths of various properties. In this apparatus, the quality of clothes is roughly determined as one of a soft quality and a stiff quality. As the washer is controlled according to a signal indicative of such a roughly sensed clothes quality, it is impossible to eliminate completely a damage of clothes during washing.

SUMMARY OF THE INVENTION

Therefore, an object of the invention is to provide an apparatus for and a method of determining the quality of clothes to be washed in a washer, wherein a sensing signal indicative of the quality of clothes is analyzed, to determine whether the clothes quality signal is a meaningful signal or a noise, so that when the clothes quality signal is the meaningful signal, a rotation speed of the washer is controlled by the clothes quality signal, for minimizing a damage of the clothes.

In accordance with one aspect, the present invention provides an apparatus for determining the quality of clothes to be washed in a washer, comprising: clothes quality sensing means for sensing the quality of said clothes from the magnitude of an impact generated by the clothes and generating a clothes quality signal; correlation coefficient operating means for analyzing said clothes quality signal outputted from said clothes quality sensing means and outputting a correlation coefficient for determining whether the clothes quality signal is a meaningful signal or a noise; and a microprocessor for controlling a rotation speed of said washer according to the clothes quality signal, when the clothes quality signal currently inputted is determined to be said meaningful signal, from said correlation coefficient.

In accordance with another aspect, the present invention provides a method of determining the quality of clothes to be washed in a washer, comprising the steps of: (a) supplying a water into a washing tub of said washer and then sensing the quality of said clothes while agitating the clothes for a predetermined time by driving a motor, to generate a clothes quality signal; (b) receiving said clothes quality signal outputted at said step (a) and operating a correlation coefficient of the clothes quality signal, to determine whether the clothes quality signal is a meaningful signal or a noise; and (c) controlling a rotation force of said motor according to the clothes quality signal when the clothes quality signal has been determined to be the meaningful signal by use of the correlation coefficient outputted at said step (b).

In accordance with the present invention, the sensing signal indicative of the quality of clothes to be washed in a washer is analyzed. When the clothes quality signal is determined to be a meaningful signal, based on the result of the analysis, the rotation force of the washer is controlled according to the clothes quality signal, thereby minimizing a damage of clothes.

BRIEF DESCRIPTION OF THE DRAWINGS

The various features and advantages of the present invention may be more readily understood with reference to the following detailed description taken in conjunction with the accompanying drawings in which.

DETAILED DESCRIPTION OF THE PREFERRED EMBODIMENTS

Figure 1:
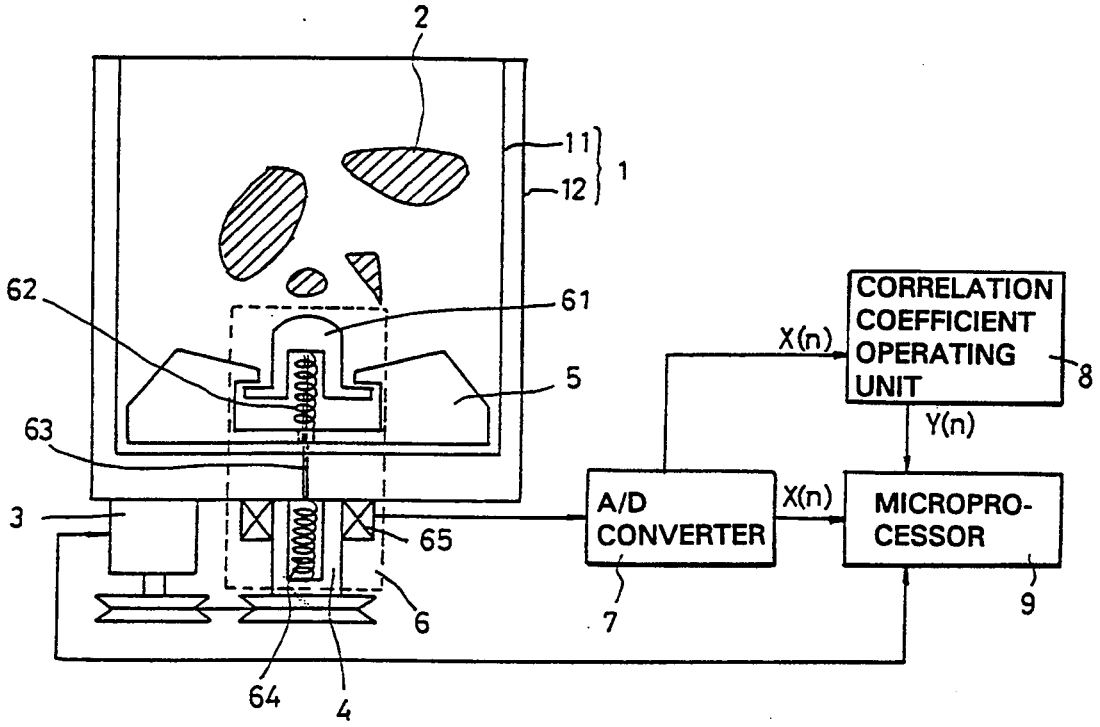
FIG. 1 is a schematic sectional view of a washer to which the present invention is applied, the view also illustrating a clothes quality determining apparatus of the present invention by a block diagram.

Referring to FIG. 1, there is schematically illustrated a washer to which the present invention is applied. In FIG. 1, a clothes quality determining apparatus of the present invention is shown by a block diagram.

As shown in FIG. 1, the washer comprises a washing tub 1 with a double structure including a dehydrating tub 11 and an outer tub 12. The washer also comprises a clutch 4 for receiving a rotation force of a motor 3 via a belt and transmitting it to the washing tub 2, and a pulsator 5 for receiving the rotation force of motor 3 and rotating clothes 2 contained in the washing tub 1 by the received rotation force.

In accordance with the present invention, the clothes quality determining apparatus comprises a clothes quality sensing unit 6 for sensing the quality of clothes 2 from the magnitude of impact generated by the clothes 2. The clothes quality sensing unit 6 is disposed between the clutch 4 and the pulsator 5. The clothes quality determining apparatus also comprises an A/D converter 7 for converting a clothes quality signal outputted from the clothes quality sensing unit 6 into a digital signal and outputting a state value X(n) of the clothes quality signal, a correlation coefficient operating unit 8 for analyzing the state value X(n) of clothes quality signal outputted from the A/D converter 7 and outputting a correlation coefficient Y(n), and a microprocessor 9 for determining whether the state value X(n) of clothes quality signal is a meaningful signal, from the correlation coefficient Y(n) outputted from the correlation coefficient operating unit 8 and controlling the rotation force of motor 3 according to the state vale X(n) of clothes quality signal when the state value X(n) of clothes quality signal is the meaningful signal. All of the A/D converter 7, the correlation coefficient operating unit 8 and the microprocessor 9 are disposed at the output side of clothes quality sensing unit 6.

Figure 2:
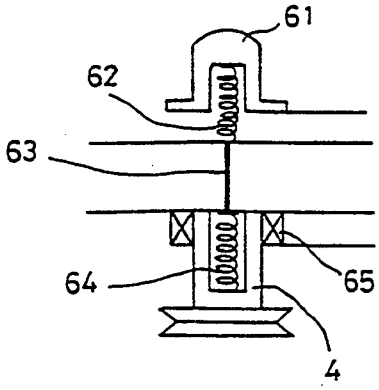
FIG. 2 is a sectional view of a clothes quality sensing unit employed in the clothes quality determining apparatus in accordance with an embodiment of the present invention.

As shown in FIG. 2, the clothes quality sensing unit 6 comprises an assistant pulsator 61 centrally disposed in the pulsator 5 and adapted to receive the impact generated by the clothes 2 being agitated according to the rotation of pulsator 5. Beneath the assistant pulsator 61, a spring 62 is disposed, which receives the impact from the assistant pulsator 61 and generates a resilience corresponding the magnitude of the impact. A spring bar 63 is disposed beneath the spring 62. The spring bar 63 is connected at its upper end to the spring 62, to receive the resilience from the spring 62. Beneath the spring bar 63, a spring 64 is disposed in the clutch 4. The spring 64 is connected to the lower end of spring bar 63 and adapted to receive the resilience from the spring bar 63 and generate a resilience corresponding to the received resilience. A magnetic sensor 65 is also provided which converts the resilience of spring 64 into an electrical signal and output a clothes quality signal.

Figure 3:
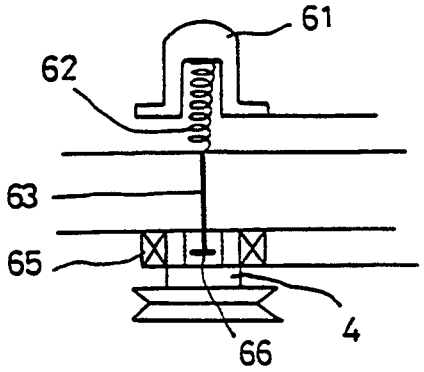
FIG. 3 is a sectional view of a clothes quality sensing unit employed in the clothes quality determining apparatus in accordance with another embodiment of the present invention.

In place of the spring 64, a magnet 66 may be used, as shown in FIG. 3. The magnet 66 serves to control a flow of current according to the resilience transmitted thereto via the spring bar 63 and generate a magnetic field.

Figure 5:
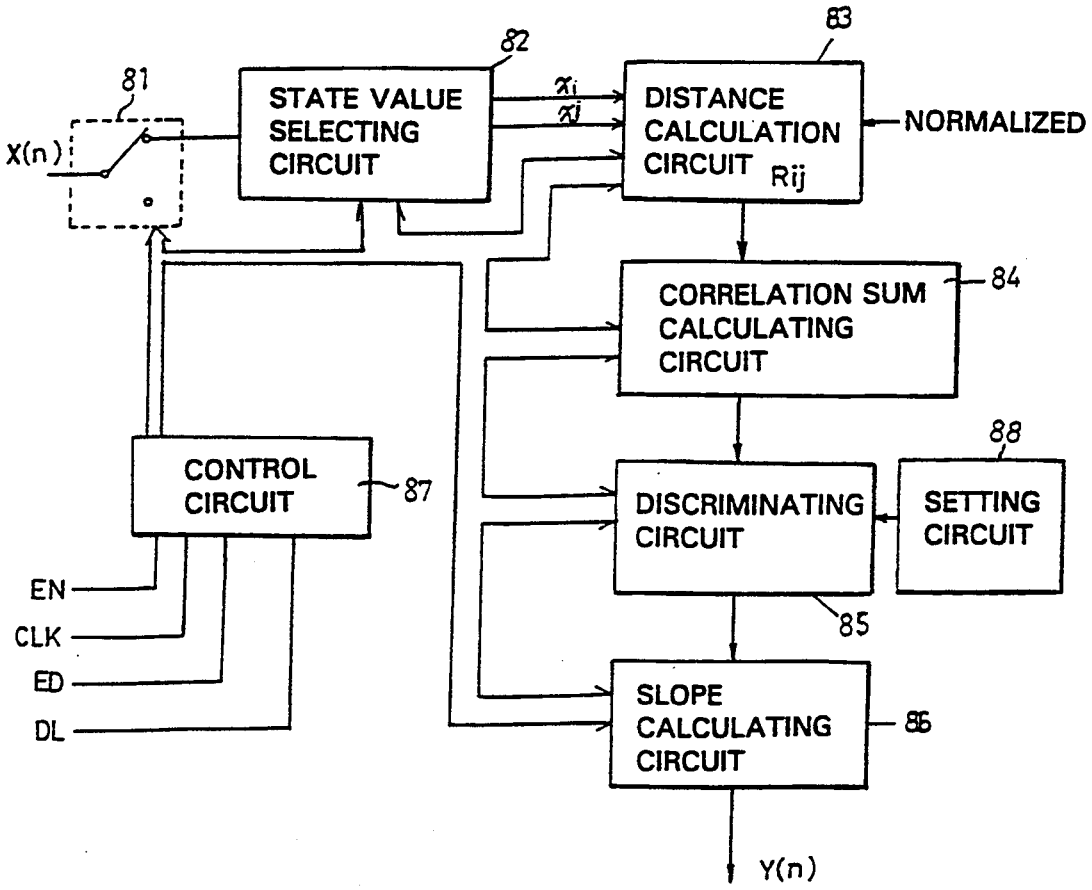
FIG. 5 is a block diagram illustrating a correlation coefficient operating unit employed in the clothes quality determining apparatus of the present invention.

As shown in FIG. 5, the correlation coefficient operating unit 8 comprises a switching circuit 81 adapted to switch state values X(n) of the clothes quality signal, which are to be analyzed, sequentially with the lapse of time and to output them, a state value selecting circuit 82 adapted to select state values outputted from the switching circuit 81, based on an embedding dimension ED and a delay time DL, and a distance calculating circuit 83 adapted to calculate a distance Rij, based on two state values Xi and Xj selected in the state value selecting circuit 82 and to output the distance Rij. A correlation sum calculating circuit 84 is also provided, which is adapted to compare the distance Rij outputted from the distance calculating circuit 83 with a previously stored distance index di and output a correlation sum C(r) corresponding to the distance index which meets a given distance condition. The correlation coefficient operating unit 8 also comprises an inflection point discriminating circuit 85 adapted to discriminate suitable inflection points of the correlation sum C(r) outputted from the correlation sum calculating circuit 84, a slope calculating circuit 86 adapted to calculate a slope of a line connecting the inflection points outputted from the inflection point discriminating circuit 85 and output the correlation coefficient Y(n), and a control circuit 87 adapted to output control signals for controlling the switching circuit 81, the state value selecting circuit 82, the distance calculating circuit 83, the correlation sum calculating circuit 84 and the discriminating circuit 85, based on an input clock CLK, an enable signal EN, the embedding dimension ED and the delay time DL.

The state value selecting circuit 82 includes a pair of registers. A setting circuit 88 is connected to the other input of the discriminating circuit 85, so as to input an optimum inflection point from outside at the discriminating circuit 85.

Figure 7:
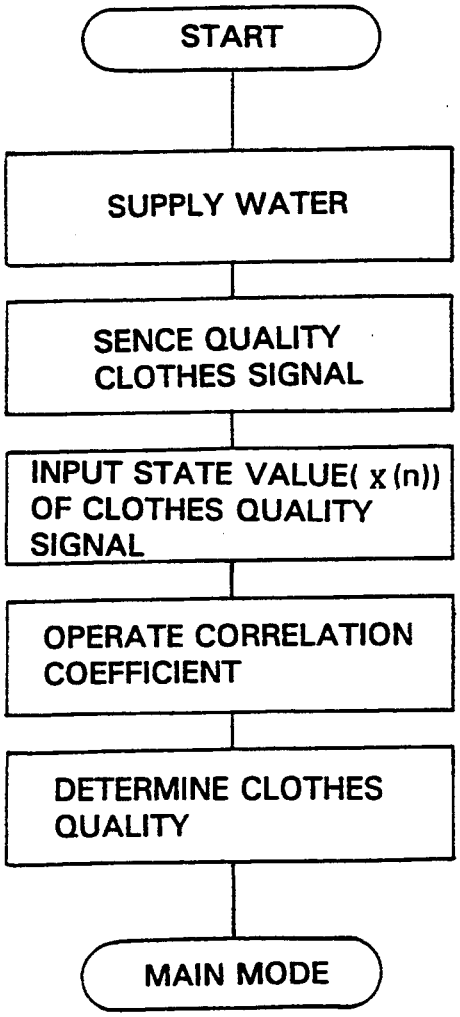
FIG. 7 is a flow chart illustrating a method of determining the quality of clothes to be washed in a washer, in accordance with the present invention.

Referring to FIG. 7, there is illustrated a method of determining the quality of clothes to be washed in the washer by use of the above-mentioned clothes quality determining apparatus, in accordance with the present invention. This method comprises a first procedure of supplying a washing water into the washing tub and then sensing the quality of clothes while agitating the clothes for a predetermined time by driving the motor, to generate a clothes quality signal, a second procedure of receiving the clothes quality signal outputted at the first procedure and operating a correlation coefficient of the clothes quality signal, to determine whether the clothes quality signal is a meaningful signal or a noise, and a third procedure of controlling the rotation force of motor according to the clothes quality signal when the clothes quality signal has been determined to be the meaningful signal by use of the correlation coefficient outputted at the second procedure.

Functions and effects of the clothes quality determining apparatus and method will now be described, in conjunction with FIGS. 1 to 7.

When a washing mode is selected after clothes 2 to be washed have been poured in the dehydrating tub 11 of washing tub 1, a predetermined amount of washing water is supplied in the washing tub 1. As the motor 3 is then driven, a rotation force generated from the motor 3 is transmitted to the pulsator 5 via the clutch 4, thereby causing the pulsator 5 to rotate alternatingly in a normal direction and the reverse direction.

By the alternating rotations of the pulsator 5, the clothes 2 are agitated. The clothes 2 being agitated strike against the assistant pulsator 61, so that the assistant pulsator 61 generates an impact.

As the assistant pulsator 61 is subjected to an impact from the clothes 2 as mentioned above, the impact is applied to the spring 62, as a resilience proportional to the magnitude of the impact. The resilience applied to the spring 62 is then transmitted to the spring 64 via the spring bar 63.

The resilience transmitted to the spring 64 is then converted into an electrical signal through the magnetic sensor 65, so that a clothes quality signal is generated.

Where the magnet 66 is used in place of the spring 64, as shown in FIG. 3, the resilience transmitted via the spring bar 63 is applied to the magnet 66. By the applied resilience, the magnet 66 generates a magnetic field which is, in turn, sensed by the magnetic sensor 65.

Figure 4A:
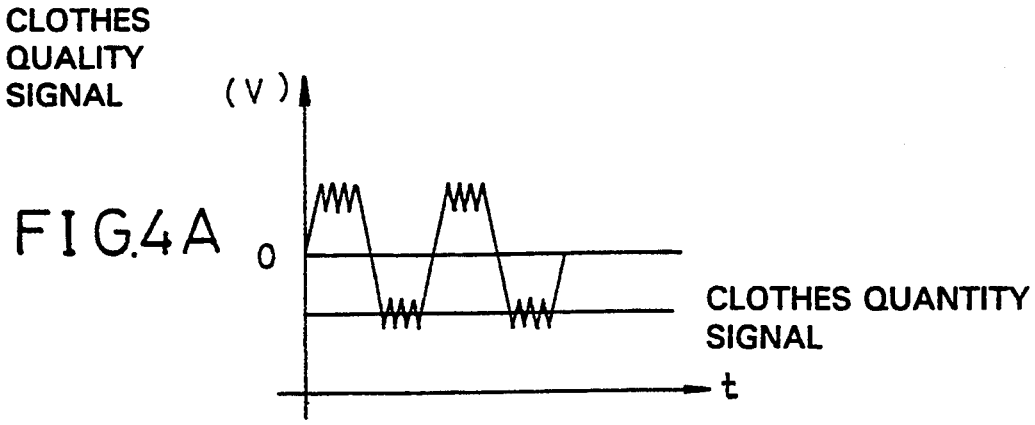
FIGS. 4A to 4E are diagrams illustrating various clothes quality signals generated from the clothes quality determining apparatus of the present invention.
Figure 4B:
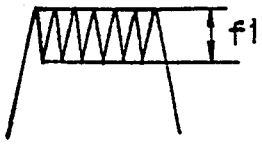
Figure 4C:
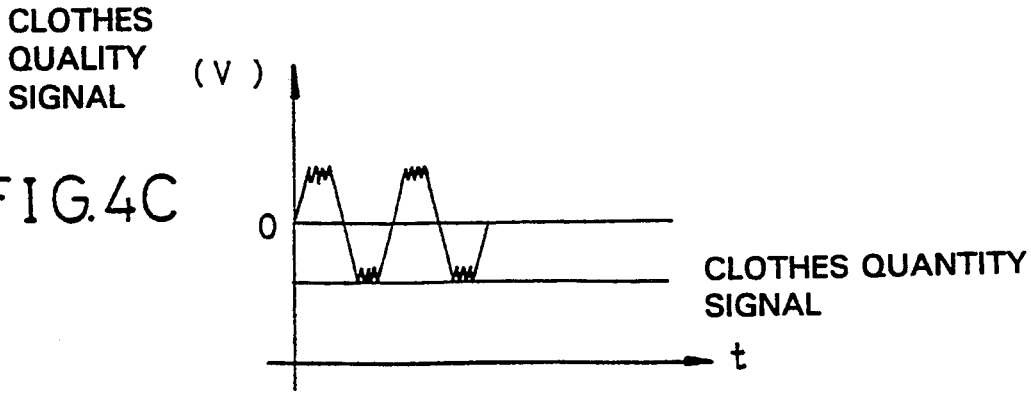
Figure 4D:
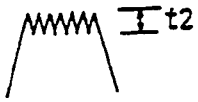

For instance, where the quality of clothes is thin and soft, a clothes quality signal with a high amplitude f1 is sensed by the magnetic sensor 65, as shown in FIGS. 4A and 4B. Where the quality of clothes is thick and stiff, a clothes quality signal with a low amplitude f2 is generated, as shown in FIGS. 4C and 4D.

Figure 4E:
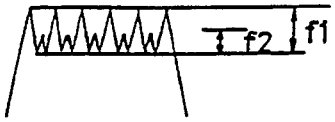

However, where the clothes include cloths of both the above-mentioned qualities, a clothes quality signal with both the amplitudes f1 and f2 are sensed through the magnetic sensor 65, as shown in FIG. 4E.

In a case of clothes with a more various quality, the clothes quality signal outputted through the magnetic sensor 65 becomes more complex.

First, such a complex clothes quality signal should be analyzed, to determine whether the clothes quality signal is a meaningful signal or a noise.

For achieving the analysis, the clothes quality signal outputted from the magnetic sensor 65 of the clothes quality sensing unit 6 is applied to the A/D converter 7 which, in turn, converts the clothes quality signal into a digital signal and thus outputs state values X(n) of clothes quality signal.

The state values X(n) of clothes quality signal are applied to the correlation coefficient operating unit 8 and selected, based on a given embedding dimension ED and a delay time DL.

This procedure will be described in conjunction with an example of an embedding dimension ED=1 and a delay time DL=t=Δt.

A state value X(n) of an input clothes quality signal is applied to the state selecting circuit 82 through the switching circuit 81 which performs its switching operation according to a control signal from the control circuit 87.

Assuming that an initial value of the inputted state X(n) is X(t0), the initial state value X(t0) is fed to the state selecting circuit 82 through the switching circuit 81. State values which are continuously inputted at every delay time t are applied to the state selecting circuit 82 through the switching circuit 81.

Namely, the initial state value X(t0) is first inputted at the state selecting circuit 82. Then, the state selecting circuit 82 receives a state value X(t0+Δt) at the delay time t0+Δt. The state values X(t0) and X(t0+Δt) are then applied to the distance calculating circuit 83 according to a control signal from the control circuit 87.

The distance calculating circuit 83 stores the inputted state values X(t0) and X(t0+Δt) in its registers, respectively, for a predetermined time and then outputs them as state values with the lapse of time.

With the outputted state values X(t0) and X(t0+Δt), the distance calculating circuit 83 calculates a distance R11 between the two state values X(t0) and X(t0+Δt). At this time, the embedding dimension ED is 1 and the delay time t is Δt. Accordingly, the distance R11 can be obtained from an operation using the following equation:

$$R11=[X(t0)-X(t0+\Delta t)]^2.$$

The calculated distance R11 is outputted under a condition that it has been normalized to be one of a maximum value Dmax, a minimum value Dmin, and other values, all of the values being optionally predetermined.

The distance R11 is then applied to the correlation sum calculating circuit 84 which; in turn, compares the inputted distance R11 with the previously stored distance index di and increments the distance index di by one when the condition of R11>di is satisfied, to obtain an incremented distance index dj.

Namely, the incremented distance index dj satisfies the following equation (2):

$$dj=di+1 \qquad (2).$$

The above procedure is performed for the delay time Δt. The switching circuit 81 supplies a state value X(t0+2Δt) received therein at the next delay time 2Δt. Based on the inputted state value X(t0+2Δt) and the initial state value X(t0), the distance calculating circuit 83 outputs a distance R12 between the two state values.

The outputted distance R12 is compared with the previously stored distance index dj through the correlation sum calculating circuit 84. When the compared result satisfies the condition of R12>dj, the distance index dj is incremented.

The above procedures are repeated with respect to all state values received with the lapse of delay time. When the number of states Ndj, which is present in a circle having a diameter corresponding to the incremented distance index, reaches the predetermined final number Dmax, no input state value is applied to the state value selecting circuit 82 via the switching circuit 81.

Namely, in such a case that the number of states Ndj present in the circle having the diameter which corresponds to the distance index dj has been determined to reach the final number Dmax through the correlation sum calculating circuit 84, a control signal is supplied from the control circuit 87 to the switching circuit 81 so that the switching circuit 81 performs its switching operation. By the switching operation of switching circuit 81, the supplying of state value to the state value selecting circuit 82 is shut off.

In the mean while, the discriminating circuit 85 receives a control signal from the control circuit 87 and selects the distance indexes di and dj having a suitable inflection point in a graph which represents the number of states Ndj present in the circle having the diameter corresponding to the inputted distance index.

The inflection point may be selected as the distance indexes di and dj previously set in the discriminating circuit 85. Otherwise, the user may set the inflection point through the setting circuit 88 at outside.

Where distance indexes have been previously set through the discriminating circuit 85, in order to derive the inflection point, a distance index is selected from optional distance indexes di and dj. A search is made for a distance index which satisfies the minimum distance from a line connecting the selected distance index and the other distance index. Once the distance index is found, a procedure for setting the found distance index as the inflection point is performed to determine a suitable inflection point. Where the distance index is determined by the setting circuit 88, an optimum inflection point derived experimentally is determined from outside.

The inflection point determined as above is fed to the slope calculating circuit 86. Where an X-Y coordinate plane is made by an axis d-axis indicative of the distance index and an axis Nd indicative of the number of state values being present in a circle with a diameter equivalent to the distance index, the slope calculating circuit 86 calculates a slope resulted from the incremented number of state values.

At this time, the slope is calculated by using the following equation (3):

$$\text{Slope}=[\log(Ndj)-\log(Ndi)]/[\log(dj)-\log(di)] \qquad (3)$$

The calculated slope is the correlation coefficient of clothes quality signal state values, namely, a final output Y(1) of the correlation coefficient operating unit 8.

The correlation coefficient of clothes quality signal state values, which is obtained on the assumption that the embedding dimension ED is 1; and the delay time DL is Δt, refers to as a correlation coefficient according to a pointwise method.

Where the embedding dimension ED and the delay time DL (DL=t) are assumed as n and tΔp, respectively, the state value selecting circuit 82 outputs state values Xi at the time t0 through the switching circuit 81 for the time $(n-1)p\Delta t$.

The state values can be expressed by the following equation:

$$Xi=[X(t0), X(t0+p\Delta t), \ldots, X(t0+(n-1)p\ \Delta t)].$$

Also, the state values Xj at the time $t0+\Delta t$ can be expressed by the following equation:

$$Xj=[X(t0+\Delta t), X(t0+(p+1)\Delta t), \ldots, X(t0+np\Delta t)$$

The distance value Rij calculated from the above state values is $[Xj-Xi]^2$. Based on the calculated distance, the correlation dimension Y(n) of clothes quality state values can be obtained through the correlation calculating circuit 84, the discriminating circuit 85, the slope calculating circuit 86, and the control circuit 87.

Figure 6:
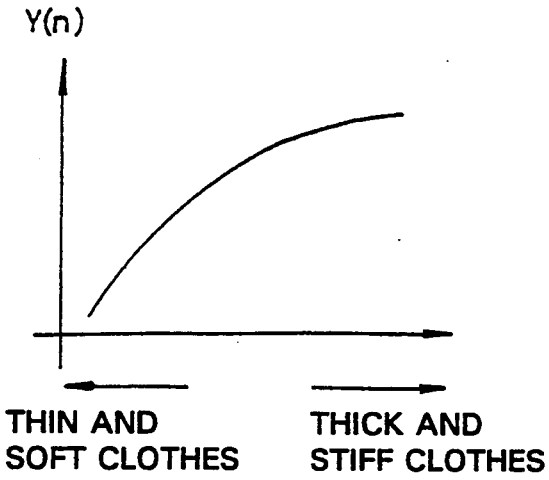
FIG. 6 is a graph illustrating correlation coefficients obtained in the clothes quality determining apparatus of the present invention.

FIG. 6 is a graph illustrating final correlation coefficients outputted from the correlation coefficient operating unit 8.

From the obtained correlation coefficient Y(n), a determination is made about whether the state value of input clothes quality signal is a clothes quality signal obtained from a meaningful signal or a clothes quality signal obtained from a noise.

The correlation coefficient Y(n) is applied to the microprocessor 9, so as to control the rotation force of motor 3 according to the state value of clothes quality signal received via the A/D converter 7.

As apparent from the above description, the present invention provides clothes quality determining apparatus and method capable of analyzing a clothes quality signal generated when clothes to be washed in a washer include cloths of various qualities, to determine whether the clothes quality signal is a clothes quality signal obtained from a meaningful signal or a clothes quality signal obtained from a noise, and controlling a rotation force of the washer according to the determined clothes quality signal, thereby minimizing a damage of clothes.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for determining the quality of clothes to be washed in a washer, comprising:

clothes quality sensing means for sensing the quality of said clothes from the magnitude of an impact generated by the clothes and generating a clothes quality signal;

correlation coefficient operating means for analyzing said clothes quality signal outputted from said clothes quality sensing means and outputting a correlation coefficient for determining whether the clothes quality signal is a meaningful signal or a noise; and a microprocessor for controlling a rotation speed of said washer according to the clothes quality signal, when the clothes quality signal currently inputted is determined to be said meaningful signal, from said correlation coefficient.

2. An apparatus in accordance with claim 1, wherein said clothes quality sensing means comprises:

an assistant pulsator for receiving said impact from said clothes being agitated;

a first spring for receiving the impact from said assistant pulsator and generating a resilience according to the received impact;

a spring bar for receiving said resilience from said first spring;

a second spring for receiving the resilience from said spring bar and generating a resilience of the same magnitude as the received resilience; and a magnetic sensor for converting said resilience from said second spring into an electrical signal and outputting it as said clothes quality signal.

3. An apparatus in accordance with claim 1, wherein said clothes quality sensing means comprises:

an assistant pulsator for receiving said impact from said clothes being agitated;

a first spring for receiving the impact from said assistant pulsator and generating a resilience according to the received impact;

a spring bar for receiving said resilience from said first spring;

a magnet for receiving the resilience from said spring bar and generating an electrical field according to the received resilience; and a magnetic sensor for converting said electrical field from said magnet into an electrical signal and outputting it as said clothes quality signal.

4. A method of determining the quality of clothes to be washed in a washer, comprising the steps of:

(a) supplying a water into a washing tub of said washer and then sensing the quality of said clothes while agitating the clothes for a predetermined time by driving a motor, to generate a clothes quality signal;

(b) receiving said clothes quality signal outputted at said step (a) and operating a correlation coefficient of the clothes quality signal, to determine whether the clothes quality signal is a meaningful signal or a noise; and (c) controlling a rotation force of said motor according to the clothes quality signal when the clothes quality signal has been determined to be the meaningful signal by use of the correlation coefficient outputted at said step (b).

* * * * *